United States Patent [19]

Keener

[11] 4,378,093

[45] Mar. 29, 1983

[54] GRINDER PUMP CUTTER ASSEMBLY

[76] Inventor: Steven M. Keener, 890 TR 875 Rte. 3, Ashland, Ohio 44805

[21] Appl. No.: 215,265

[22] Filed: Dec. 11, 1980

[51] Int. Cl.[3] ..... B02C 23/36

[52] U.S. Cl. ..... 241/46 B; 241/46.06; 415/121 B

[58] Field of Search ..... 241/46 B, 46.06, 46.11, 241/46.17; 415/121 B

[56] References Cited

U.S. PATENT DOCUMENTS 3,777,993 12/1973 Crandall ..... 241/46 B

FOREIGN PATENT DOCUMENTS 244492 4/1963 Australia ..... 241/46.06
884178 3/1953 Fed. Rep. of Germany ... 241/46.06
2813617 10/1978 Fed. Rep. of Germany ... 415/121 B
306127 3/1955 Switzerland ..... 241/46.06

*Primary Examiner*—Howard N. Goldberg
*Attorney, Agent, or Firm*—Oldham, Oldham, Hudak, Weber & Sand Co.

[57] ABSTRACT

A grinder pump cutter assembly having a pair of cutting blades mounted on the cutter disk which extend at a hook angle to substantially the center of the disk. The blade is multi-surfaced, with the surfaces thereof being angled toward the periphery of the disk to break up centralized matter and disperse it into cutting engagement between the disk and cutter ring. Both the disk and cutter ring are also characterized by bores passing through juxtaposed circumferences thereof. The bores each have a hook angle associated therewith to define the sharpness of the cutting edges and to further provide a turbulence of self-purging action within the bores.

9 Claims, 4 Drawing Figures

GRINDER PUMP CUTTER ASSEMBLY

TECHNICAL FIELD

The invention herein resides in the art of grinder pumps of the type typically used in sewage systems for reducing solid or semisolid matter into a particulate effluent. More specifically, the invention presents a cutter assembly for such grinder pumps.

BACKGROUND ART

Heretofore, in the art, numerous grinder pump designs have been implemented for reducing sewage to a fine particulate size which might be easily disposed. Applicant is aware of grinder pumps presented in U.S. Pat. Nos. 3,961,758; 3,589,623; 3,938,744; 3,726,486; 4,108,386; and 3,650,481. These prior art grinder pumps are of general interest in that they teach the desirability of grinding solid or semisolid matter, typically maintained in a fluid, into an effluent of a nearly homogeneous composition. To achieve such grinding, various types of cutter assemblies have been proposed, such cutters typically including a cutter ring having a cutter disk concentrically maintained therewithin. While this prior art is of general interest, all such art and commercially available assemblies known to applicant have certain inherent drawbacks associated therewith.

One drawback of the prior art is the inability of the grinder pumps to accommodate rubber or other elastomeric type substances which might be passed into the sewage system. Since known grinder pumps operate on the principle of grinding rather than cutting, such elastomeric materials have a tendency to wrap themselves about the cutter disk, between the disk and ring, thereby inhibiting the grinding action.

Further problems inherent with the prior art structures include the inability of the cutter assembly to clean or purge itself. In operation, many known cutters allow a ball of material to congregate about the center of the cutter disk at the point at which the disk is connected to the cutter shaft, this congregation of matter resulting from the fact that the cutter blade does not extend inwardly to the center of the disk, but is only present near the outer periphery where the grinding action occurs. Yet further, known grinder pump designs typically include blade configurations and angles which encourage, rather than discourage, the coagulation of matter at the blade or within cutter passages, such coagulation resulting in a significant decrease in operational efficiency.

DISCLOSURE OF INVENTION

In light of the foregoing, it is an object of a first aspect of the invention to provide a grinder pump cutter assembly having sharper cutting surfaces than previously known in the art, such cutting surfaces extending completely through both the cutter disk and ring.

Yet an additional object of an aspect of the invention is to provide a grinder pump cutter assembly which is self-cleaning, having purging features associated with the cutting elements.

Another object of an aspect of the invention is to provide a grinder pump cutter assembly wherein the previously known balling effect of matter at the center of the cutter disk is eliminated by providing maximum blade extension near the center of the disk.

A further object of an aspect of the invention is to provide a grinder pump cutter assembly wherein balling of matter at the center of the cutter disk is eliminated by extending the cutter blades all the way to the edge of the mounting bore of the disk.

Yet a further object of an aspect of the invention is to provide a grinder pump cutter assembly which assures that balling does not occur, that effluent particulate size is minimized, and that self-cleaning and purging of the cutting elements is achieved by providing through-cutting by means of bores on both the cutter and cutter ring and providing optimum hook angles and other angles of inclination on the blade surfaces.

Yet a final object of an aspect of the invention is to provide a grinder pump cutter assembly which is inexpensive to construct, reliable and durable in operation, and readily implemented utilizing state-of-the-art techniques and structures.

The foregoing and other objects of the invention which will become apparent as the detailed description proceeds are achieved by a grinder pump, the improvement of a cutter assembly comprising: a cutter ring having a plurality of bores extending through an inner circumference thereof; and a disk received by and rotatable within said cutter ring, said disk being maintained upon a shaft and having a pair of blades depending therefrom, said blades extending from an outer circumference of said disk inwardly to said shaft.

BRIEF DESCRIPTION OF DRAWINGS

For a complete understanding of the objects, techniques, and structure of the invention, reference should be had to the following detailed description and accompanying drawings therein.

BEST MODE FOR CARRYING OUT THE INVENTION

Figure 1:
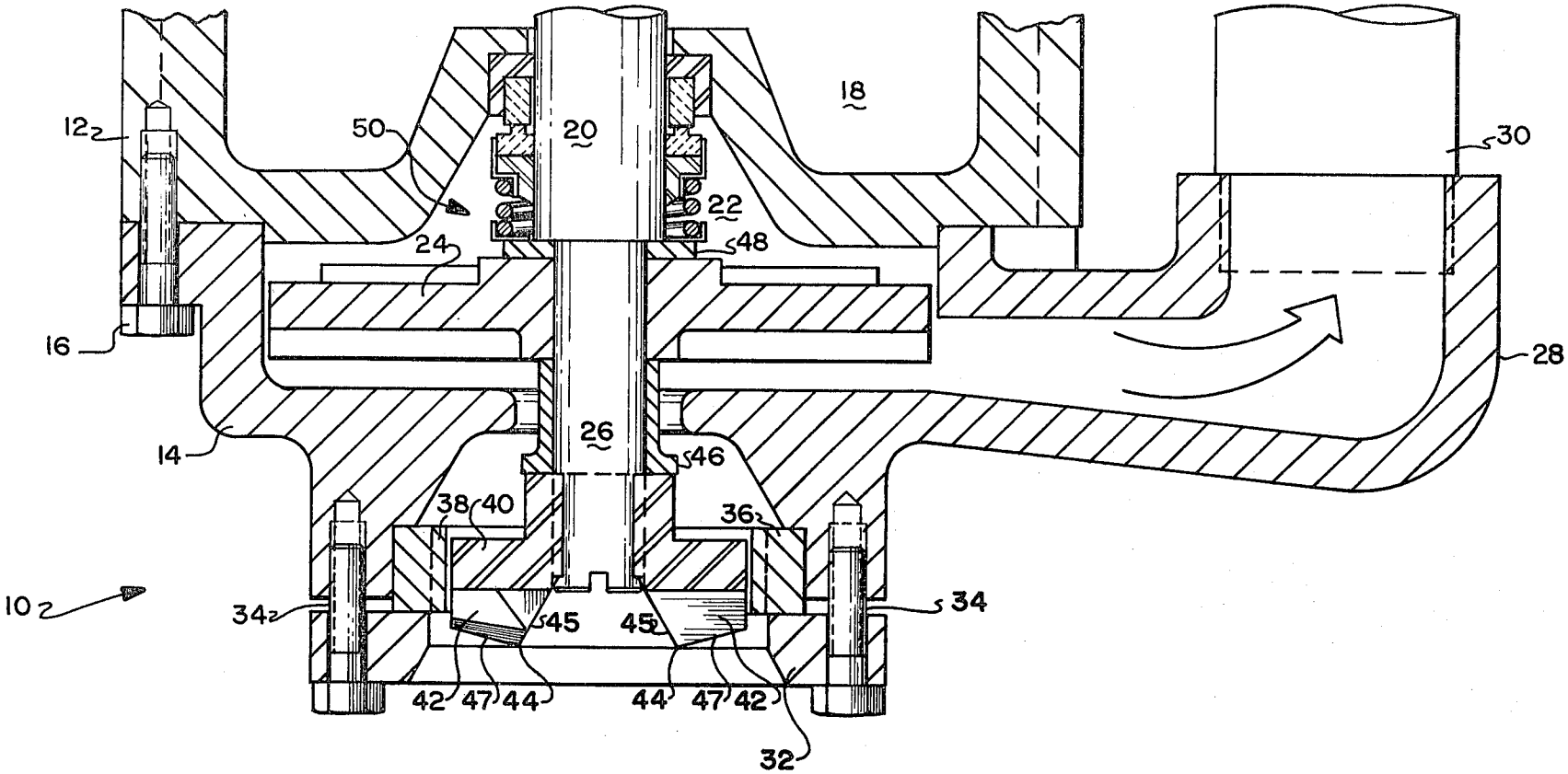
FIG. 1 is a partial sectional view of the wet end of a grinder pump incorporating the concepts of the invention.

Referring now to the drawings and more particularly FIG. 1, it can be seen that the wet end of a grinder pump assembly according to the invention is designated generally by the numeral 10. Included is an upper casing 12 having a lower casing 14 attached thereto by means of bolts 16 or other appropriate fasteners. A reservoir 18, partially shown, is provided for receiving oil or other lubrication media for lubricating the drive shaft 20 which is connected in standard fashion to the pump motor (not shown). Suffice it to say that those skilled in the art would readily perceive means for interconnecting the motor to the drive shaft 20 to effectuate the desired rotational movement common to grinder pumps.

A pump chamber 22 is defined between the upper casing 12 and lower casing 14 and receives therein an impeller pump 24 appropriately attached, as by threading, to the pump and cutter shaft 26. Of course, the shaft 26 is connected to the drive shaft 20 for rotational movement by the pump motor. The impeller pump 24 can be of any conventional means, but is preferably a ten vane pump to provide a suitable head for moving the effluent from the wet end, through the grinder assembly, and out the discharge port 28. In standard fashion, the port 28 has attached thereto a discharge tube 30 for passage to the remainder of the sewage system.

As is well known in the art, the wet end 10 of the grinder pump assembly is open for receiving thereat solid or semisolid matter maintained in a media which is typically of a fluid nature. In the preferred embodiment of the invention, the wet end 10 includes a keeper ring 32 attached by bolts 34 to the lower casing 14, the keeper ring 32 maintaining the cutter ring 36 in position at the open end of the pump assembly. A plurality of cutting bores, to be described hereinafter, characterize the inner circumference of the cutter ring 36.

Received within the cutter ring 36 is an annular cutter disk 40 which is threadedly engaged with or otherwise secured to the pump and cutter shaft 26. While the cutter disk 40 will be described in detail hereinafter, it should be noted that the disk is characterized by a pair of blades 42 which extend from the bottom thereof. As illustrated, the blades 42 extend from the outer circumference of the cutter disk 40 to the innermost point where the disk 40 is threadedly secured to the shaft 26. The lowermost point of extension of the blades 42, designated by the numeral 44, is positioned near the point of attachment to the shaft 26 as defined by the intersection of the edges 45,47, the former forming an angle of approximately 45° with the horizontal, and the latter forming an angle therewith of approximately 15°. While the specific angles just recited might vary plus or minus 5°, it is to be understood that it is desired that the maximum point of extension of the blade 42 lie near the center of the disk 40, and from that point, the blade is to be angled toward the center of the disk. This extension of the blade breaks up matter tending to ball at the center of the disk and urges it toward the cutting surfaces between the disk 40 and ring 36 as by the incline of the angled edge 45. Similar urging toward the cutting surfaces is achieved by means of the angle of the edge 47.

As illustrated in FIG. 1, the cutter ring 36 is maintained by the keeper 32 and bolts 34. The blade 40 is threaded upon the shaft 26 into securing engagement with the spacer 46. This spacer secures the impeller 24 against the washer 48 which is maintained in biased relationship within the chamber 22 by means of the seal and biasing spring assembly 50. The seals prevent leakage of effluent into the reservoir 18 while the biasing spring maintains the cutter and impeller assembly elements in proper fixed relationship to each other.

Figure 2:
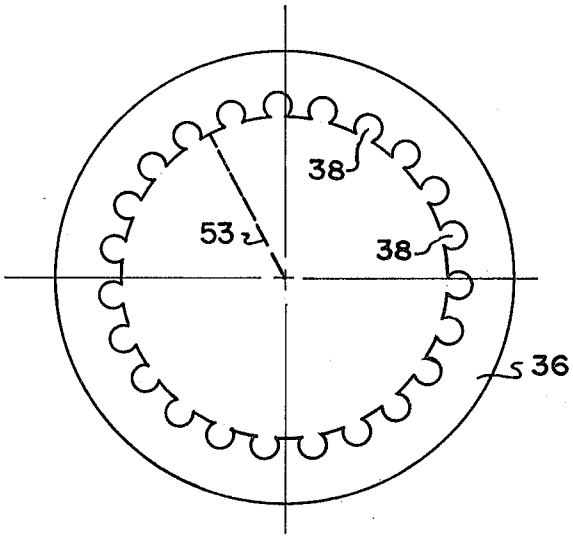
FIG. 2 is a top plan view of the cutter ring of the invention.

With reference now to FIG. 2, it can be seen that the cutter ring 36 is characterized by a plurality of cutting bores 38 passing about the inner circumference thereof. The centers of the bores 38 preferably lie upon a circle having a radius greater than the inner radius 53 of the ring 36 plus the radius of the bores 38. This arrangement provides for a hook angle for the cutting edges defined by the intersection of the bores 38 with the inner circumference of the ring 36. This hook angle is regulated by the radius of the circle defining the locus of centers of the bores 38. It will be appreciated that such a hook angle sharply defines the cutting edges of the bores 38 and also provides for a turbulence of effluent within such bores.

Figure 3:
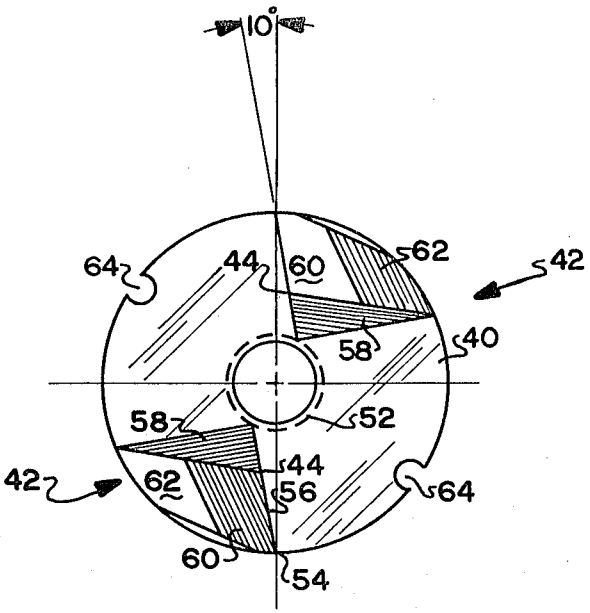
FIG. 3 is a bottom plan view of the cutter blade disk assembly of the invention.
Figure 4:
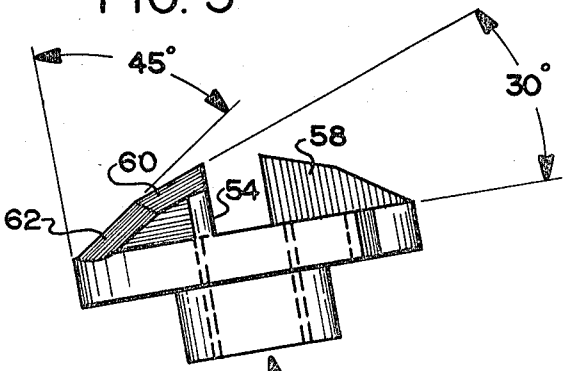
FIG. 4 is a side elevational view of the cutter disk of the invention taken at the hook angle of the extended cutter blade.

With reference now to FIGS. 3 and 4, the cutter disk 40 may be seen in greater detail. A threaded bore 52 passes through the disk 40 for securing the same to the shaft 26 as illustrated in FIG. 1. Of course, the bore 52 is finely machined for concentrically with respect to the disk 40 such that the disk may be maintained in close registered juxtaposition with the ring 36. The blades 42, shown illustratively in FIG. 1, include a plurality of angled surfaces and edges as is apparent in the last two figures hereof. The cutting edge 54 is flush with the outer circumference of the disk 40 and is defined by the intersection of the surface 56 with the outer circumference of the disk 40. The surface 56 is orthogonal to the base surface of the disk 40 and extends at a preferred angle of 10° from a radius of the disk extending through the cutting edge 54. This 10° hook angle provides for an extremely sharp cutting edge 54 while also providing for movement of effluent away from the center of the disk.

The blades 42 also include back surfaces 58 which are sloped away from the center of the disk 40 at approximately 30° to pull effluent from the center of the disk 40 to the cutting area between the disk and ring 40,36. A primary top surface 60 is angled toward the circumferential edge of the disk 40 as is a secondary top surface 62. Both surfaces 60,62 intersect the back surface 58 with the respective lines of interconnection between the surfaces 60,62 and the surface 58 being 30° and 45° with the horizontal.

With further reference to FIGS. 3 and 4, it will be seen that the outer circumference of the disk 40 is characterized by a pair of bores 64, the centers of the bores 64 lying on a common circle inside the outer circumference of the disk 40. By this arrangement, the cutting surfaces defined by the edges of the bores 64 and the circumference of the disk 40 have a hook angle determining the sharpness of such edge. The bores 64 pass completely through the thickness of the disk 40 in much the same fashion as the bores 38 pass through the ring 36.

With the unit assembled as in FIG. 1, it will be noted that when the edges of the bores 64 or the cutting edge 54 pass an edge of the bores 38, a shearing effect takes place at least between pairs of edges of such bores. The cylindrical nature of the bores allows the same to be constantly purged by the turbulent effluent passing therethrough and, being without any sharp corners, the bores have no area for coagulating such effluent. Similarly, the shearing engagement between the cutting edge 54 and the bores 38 allows for continual passage of effluent through the cutter assembly, assuring continual purging of the cylindrical cutting bores 38.

The blades 42, extending all the way to the mounting bore 52 and having each of the angled surfaces thereof directed toward the outer circumference of the disk 40, continually seek to break up matter which might congregate at the center of the disk and disperse the same toward the cutting engagement of the ring and disk assembly. With the maximum extension 44 of the blades 42 being near the center of the disk, and with the edge 45, shown in FIG. 1, being angled away from the center, any congregation of matter which might seek to ultimately clog or plug the open intake of the grinder pump will itself be broken up, particulated, and dispersed through the discharge port 28.

Thus, it can be seen that the objects of the invention have been achieved by the structure presented hereinabove. While in accordance with the patent statutes only the best mode and preferred embodiment of the invention have been presented and described in detail, it will be understood that the invention is not limited thereto or thereby. Accordingly, for an appreciation of the true scope and breadth of the invention, reference should be had to the following claims.

What is claimed is:

1. In a grinder pump, the improvement of a cutter assembly, comprising:

a cutter ring having a plurality of bores extending through an inner circumference thereof, the centers of said bores lying on a circle of greater radius than the radius of said inner circumference of said ring; and a disk received by and rotatable within said cutter ring, said disk being maintained upon a shaft and having a pair of blades depending therefrom, said blades extending from an outer circumference of said disk inwardly to said shaft, said disk having a pair of bores passing through said outer circumference of said disk, the centers of said pair of bores lying on a circle having a radius less than the radius of said outer circumference of said disk.

2. The cutter assembly as recited in claim 1 wherein said bores of said disk are diametrically opposed and spaced equidistant between said blades.

3. The cutter assembly as recited in claim 1 wherein said blades are multisurfaced, the surfaces thereof being angled toward said outer circumference.

4. The cutter assembly as recited in claim 3 wherein said blades form a hook angle of approximately 10° with a diameter of said disk.

5. The cutter assembly as recited in claim 4 wherein each said blade includes a back surface sloped from said shaft toward said outer circumference of said disk, said back surface intersecting primary and secondary top surfaces of said blades, each said top surface being sloped toward said outer circumference.

6. The cutter assembly as recited in claim 5 wherein said primary and secondary top surfaces intersect said back surface at respective approximate angles of 30° and 45°.

7. A cutter assembly for a grinder pump, comprising:

a cutter ring having a plurality of bores about an inner periphery thereof; and a disk maintained upon a shaft and rotatable within said ring, said disk having a pair of bores about the circumference thereof and further having a pair of blades extending from the bottom thereof, each said blade having a back surface sloped toward said circumference of said disk and beginning at said shaft, wherein said blades are maintained upon said disk at a hook angle, and wherein each said blade further includes primary and secondary top surfaces intersecting said back surface and sloping toward the circumference of said disk.

8. The cutter assembly of claim 7 wherein said bores of both said ring and disk are of a cylindrical nature, each such bore comprising more than one-half of a cylinder.

9. The cutter assembly of claim 8 wherein said primary and secondary top surfaces and said back surface obliquely intersect each other.

* * * * *